US011732993B2

(12) United States Patent
Laughlin

(10) Patent No.: US 11,732,993 B2
(45) Date of Patent: Aug. 22, 2023

(54) TRIGGER GUIDE

(71) Applicant: Daniel Sean Laughlin, Carlsbad, CA (US)

(72) Inventor: Daniel Sean Laughlin, Carlsbad, CA (US)

( * ) Notice: Subject to any disclaimer, the term of this patent is extended or adjusted under 35 U.S.C. 154(b) by 0 days.

(21) Appl. No.: 17/702,476

(22) Filed: Mar. 23, 2022

(65) Prior Publication Data

US 2022/0307790 A1 Sep. 29, 2022

Related U.S. Application Data

(60) Provisional application No. 63/165,248, filed on Mar. 24, 2021.

(51) Int. Cl.
*F41A 33/00* (2006.01)
*F41A 19/10* (2006.01)

(52) U.S. Cl.
CPC ..... *F41A 33/00* (2013.01); *F41A 19/10* (2013.01)

(58) Field of Classification Search
CPC ..... F41A 17/54
USPC ..... 42/70.07, 83
See application file for complete search history.

(56) References Cited

U.S. PATENT DOCUMENTS

| | | | | |
|---|---|---|---|---|
| 1,563,250 | A | 11/1925 | Capon | |
| 1,686,482 | A | 10/1928 | Windle | |
| 1,887,308 | A | 11/1932 | Jessup | |
| 2,080,202 | A | 5/1937 | Drake | |
| 2,444,649 | A | 7/1948 | Jacobs | |
| 3,022,596 | A * | 2/1962 | Cannon | F41A 17/54 42/70.07 |
| 5,926,989 | A * | 7/1999 | Oliver, Sr. | F41A 19/11 42/70.07 |
| 9,958,225 | B1 | 5/2018 | Richetti et al. | |
| 9,970,725 | B2 | 5/2018 | Kiyani et al. | |
| 10,228,206 | B2 | 3/2019 | Bordley et al. | |
| D849,176 | S | 5/2019 | Luth | |
| 2011/0047849 | A1 | 3/2011 | Brenner | |
| 2016/0109203 | A1 | 4/2016 | Madia, II et al. | |
| 2016/0341519 | A1 | 11/2016 | Gaiser | |

OTHER PUBLICATIONS

Advertisement for Kydex Trigger Guard Holster with Paracord | Tactical Trigger Holster, Ideal Inside-Waistband IWB Minimalist Holster manufactured by BASTION, retrieved from Amazon.com on Oct. 19, 2020, 8 pages.

(Continued)

*Primary Examiner* — Reginald S Tillman, Jr.
(74) *Attorney, Agent, or Firm* — Fitch, Even, Tabin & Flannery, LLP

(57) ABSTRACT

A firearm attachment is disclosed including a first side wall, a second side wall, and a bottom wall extending between the first side wall and the second side wall. The bottom wall spaces the first side wall from the second side wall to define a space therebetween for receiving a trigger guard of a firearm. The firearm attachment further includes a first attachment protrusion extending from the first side wall toward the second side wall for engaging the trigger guard of the firearm and a second attachment protrusion extending from the second side wall toward the first side wall for engaging the trigger guard of the firearm.

20 Claims, 16 Drawing Sheets

(56) References Cited

OTHER PUBLICATIONS

Advertisement for ClipDraw Trigger Sheath Trigger Guard Holster Black with Paracord manufactured by Skyline Toolworks LLC, retrieved from Amazon.com on Oct. 19, 2020, 8 pages.
Advertisement for The Trigger Trainer manufactured by Luth-AR, retrieved from 3-Gun Nation Online Store on Oct. 19, 2020, 3 pages.

* cited by examiner

TRIGGER GUIDE

CROSS-REFERENCE TO RELATED APPLICATIONS

This application claims benefit of U.S. Provisional Application No. 63/165,248, filed Mar. 24, 2021, which is hereby incorporated herein by reference in its entirety.

FIELD

This disclosure relates to firearm accessories, and in particular, to firearm training accessories.

BACKGROUND

Many occupations, such as those in the police force and military, require employees to carry a firearm and/or know how to properly use a firearm. In training for these occupations, recruits may be instructed how to properly use a firearm including how to properly hold, aim, and fire various firearms. Situations giving rise to the need to use a firearm often require one to act quickly and instinctively. A critical factor when firing a firearm is the placement of the user's finger on the trigger. If the trigger finger is not properly placed, the action of squeezing the trigger will cause the firearm twist to the left or right, which may significantly affect the trajectory of a bullet as it travels down-range. This may result in the user missing their intended target, thereby reducing the effectiveness of the use of the firearm.

Some have attempted to create a trigger guide device to aid in training a user in properly positioning their finger on the trigger. One prior device is designed to be attached to the trigger well of an assault rifle via screws or bolts. Tools are required to install or remove the trigger guide device and thus these devices do not allow a user to quickly remove or attach the trigger guide device when desired. Also, if a user does not have the proper tools with them, the trigger guide cannot be attached or detached from the firearm.

Moreover, such prior training devices are not suitable for use by employees in the field. For example, prior devices are not designed to enable a trigger guide device to remain attached to the firearm when placed in a holster. Thus, these prior trigger guide devices may be prone to snagging and catching on the holster when inserting or removing a handgun from the holster. Since prior trigger devices may be prone to catching on the holster, users are not able to use these prior trigger guides in the field due to the increased risks associated with the firearm catching on the holster when drawing the firearm.

Yet another limitation of the prior trigger guide devices is that they do not provide any indication of whether a user's finger is at the proper vertical position on the trigger. As mentioned above, improperly positioning one's finger on the trigger results in the firearm twisting as the trigger is squeezed. Accordingly, proper vertical placement on the trigger is also critical to shooting accurately and consistently.

DETAILED DESCRIPTION

With reference to FIGS. 1A-F, a trigger guide 100 is disclosed herein that is configured to be attached to a firearm 150. The trigger guide 100, when attached to the firearm 150, provides an indication to a user of whether their finger is properly positioned on the trigger 152 of the firearm 150. When a user's finger is properly placed on the trigger 152, the amount of twisting or turning of the firearm 150 as the user pulls the trigger 150 is mitigated, thereby improving the user's accuracy. After training to use the firearm 150 with the trigger guide 100 for a period of time, a user may begin to instinctively place their finger at the proper location on the trigger 152. Not only does the trigger guide 100 train a user to place their finger at the proper position, but the trigger guide 100 also trains the user to place their finger at a consistent position which also improves the user's accuracy by reducing the variation in the user's finger placement on the trigger 152. Thus, a user may be trained to place their finger at the proper position on the trigger instinctively, which is necessary in high intensity situations requiring the use of a firearm in the field. By increasing the user's accuracy in using the firearm, the overall effectiveness in the use of the weapon is increased. While described herein as being used as a trainer, the devices described herein may continue to be used with a firearm even when not in training situations. The devices may also be quickly removable, such as in non-training situations, without the need for tools or cumbersome removal steps.

Figure 1A:
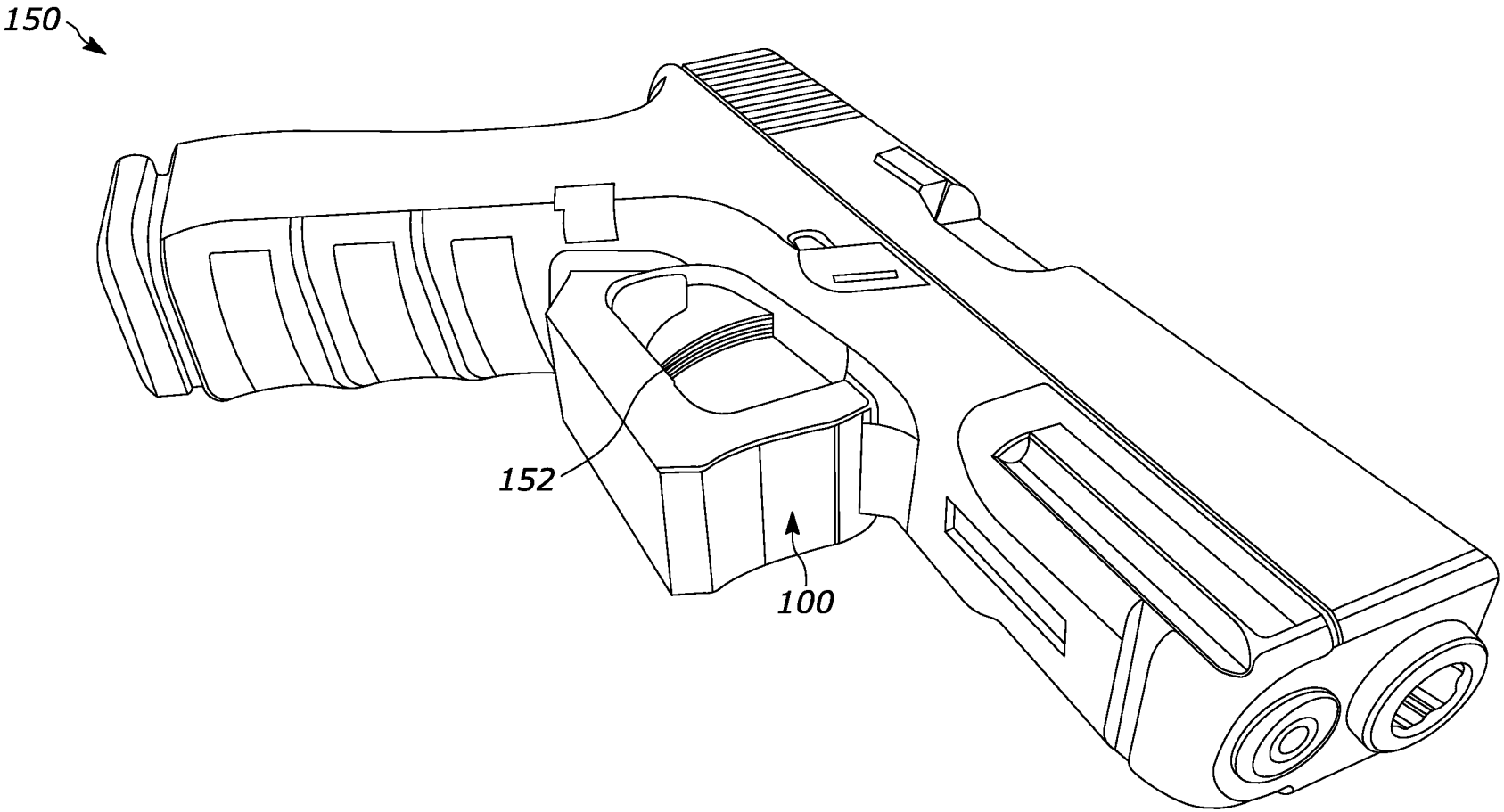
FIGS. 1A-D are front right perspective, front left perspective, left side elevation, and right side elevation views, respectively, of a trigger guide mounted to a firearm.
Figure 1B:
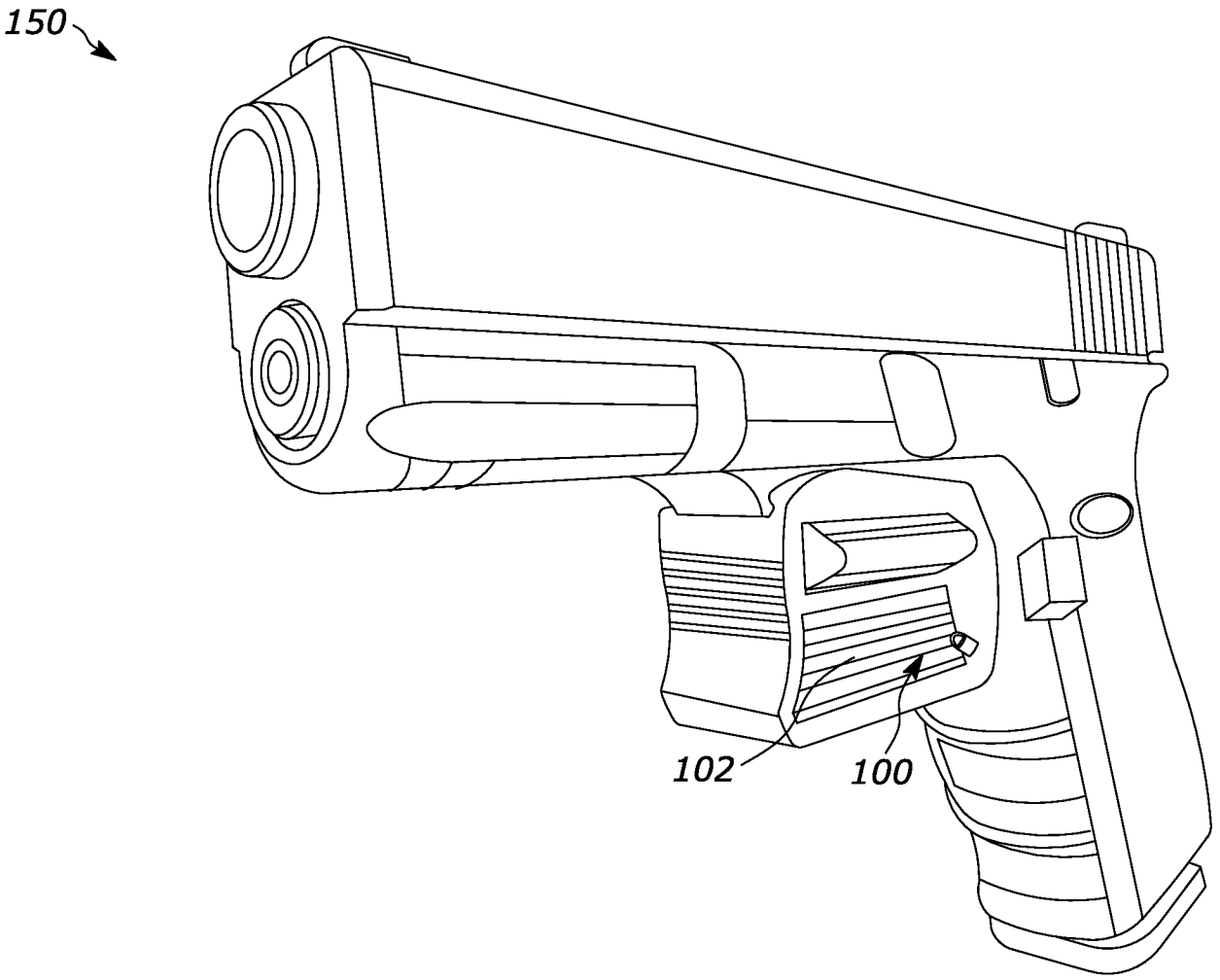
Figure 1C:
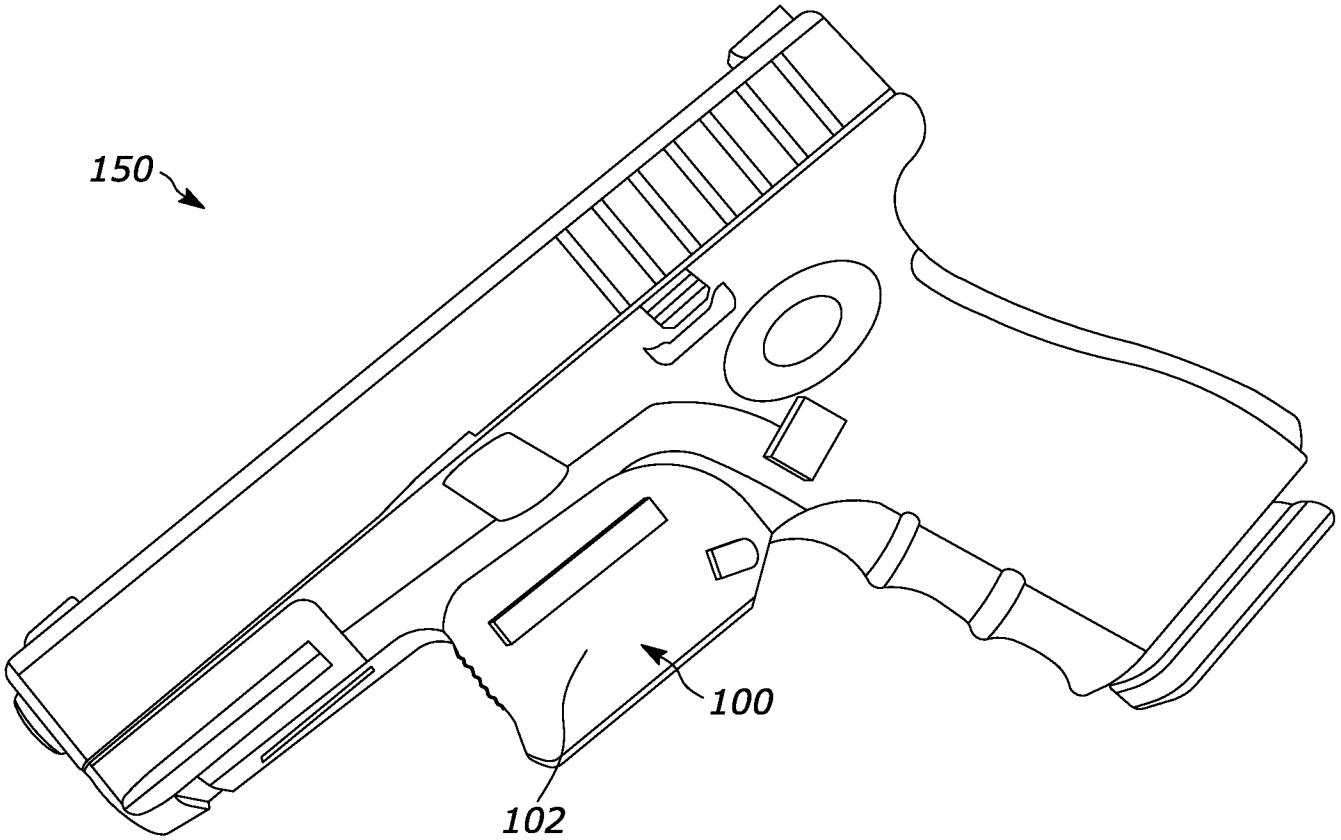
Figure 1D:
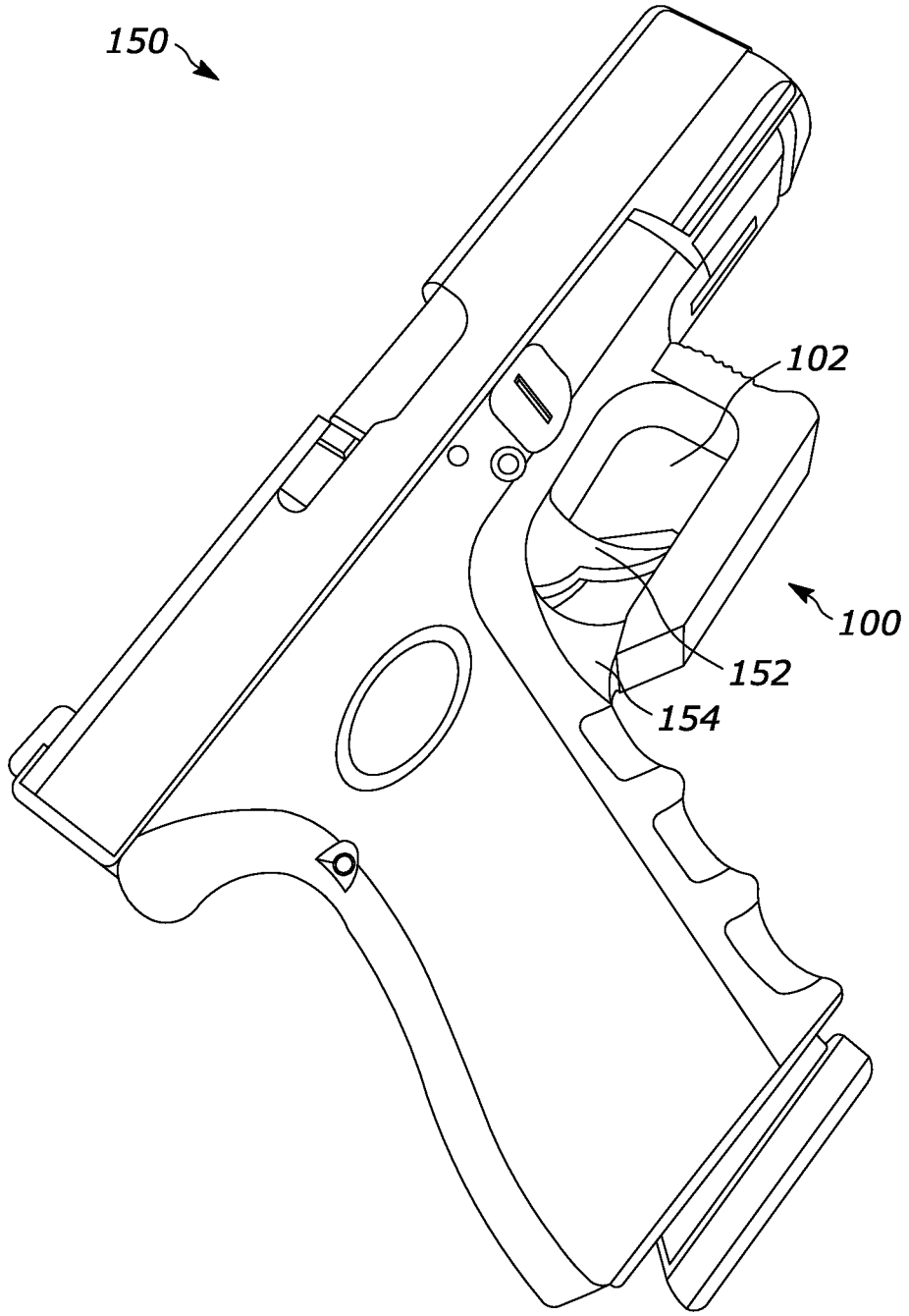
Figure 1E:
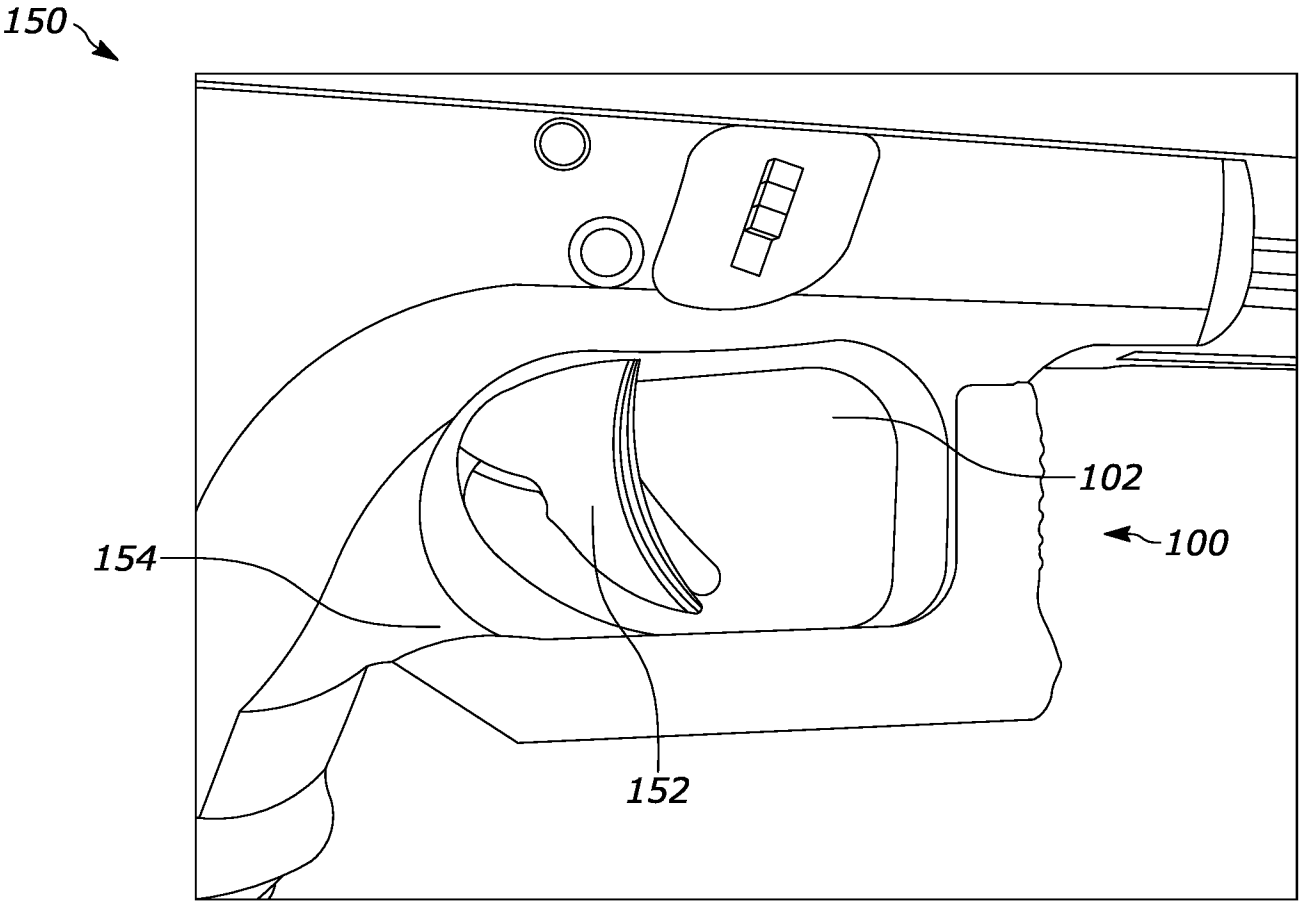
FIG. 1E is a right side closeup view of the trigger guide mounted to the firearm.
Figure 1F:
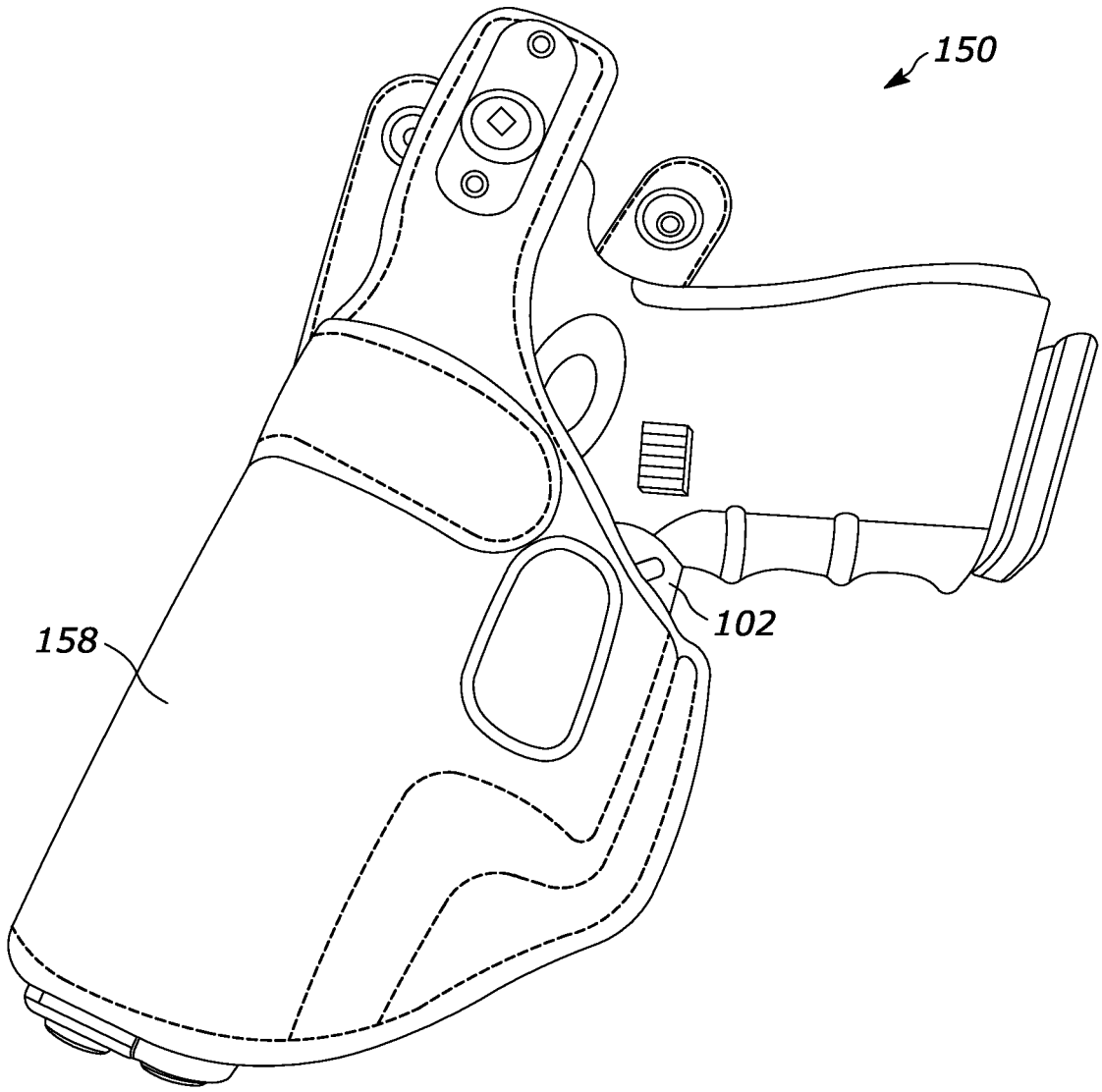
FIG. 1F is a left side elevation view of the trigger guide mounted to the firearm and inserted into a holster.

As shown in FIGS. 1A-F, the trigger guide 100 may attach to the trigger guard 154 of the firearm 150. The trigger guide 100 may serve as an attachment to the firearm 150 that guides a user when firing the firearm 150 to increase the accuracy of the user. In the embodiment shown, the trigger guide 100 has a narrow profile about the trigger guard 154 that enables the firearm 150 to be placed in a holster 158 along with the trigger guide 100 as shown in FIG. 1F. This enables users to continue training to properly position their finger on the trigger 152 even when in the field or outside of formal training. While the embodiment shown in FIGS. 1A-F shows the trigger guide 100 attached to a handgun, those having skill in the art will readily appreciate that the trigger guide 100 may similarly be adapted for use with any firearm having a trigger including, for example, rifles and shotguns.

The trigger guide 100 includes a guide plate 102 that indicates to a user that their finger is properly positioned on the trigger 152 when the user's finger engages the guide plate 102. The guide plate 102 prevents the user from extending their finger too far into the trigger well or past the trigger 152. The guide plate 102 also serves as an indication to the user when their finger needs to be extended further into the trigger well or over the trigger 152. If the user's finger is not engaging the guide plate 102 when their finger is positioned on the trigger 152, the user needs to extend their finger further into the trigger well or over the trigger 152. Thus, the guide plate 102 indicates when a user needs to move their finger laterally across the trigger 152 to the proper position. The trigger guide 100 shown in FIGS. 1A-F is for right handed shooters with the guide plate 102 positioned on the left side of the trigger 152, however, it should be understood that the trigger guide 100 may be adapted for use with left handed shooters. For instance, the trigger guide 100 may be mirrored such that the guide plate 102 of the trigger guide 100 is on the right side of the trigger 152.

One advantage of the trigger guide 100 is that it may easily be attached to and removed from a firearm without the use of tools. The trigger guide 100 may be formed of one or more elastic materials that enable the trigger guide 100 to snap on and snap off of the trigger guard 154. These materials include, but are not limited to polymer composites, nylon, carbon fiber, rubberized plastics, and the like. As one example, the trigger guide 100 may be formed of a plastic material that enables the trigger guide to snap over the trigger guard 154 of the firearm 150. This enables a user to quickly switch between using their firearm 150 with or without the trigger guide 100. This is particularly advantageous when using the trigger guide 100 in the field as the trigger guide 100 may be quickly removed by the user when needed in an emergency. For example, a normally right-handed user may find themselves in a situation where they need to shoot with their left hand. For instance, a user be required to shoot with their non-primary shooting hand in the event the user becomes injured, for example, the user sustains an injury to their firing hand, arm, or trigger finger. Or there may be some other restraint to a user shooting with their primary shooting hand.

With reference to FIGS. 2A-E, the trigger guide 100 includes the guide plate 102 and an attachment portion 104. The attachment portion 104 has a U-shape formed by a side plate 106, a portion of the guide plate 102, and a support member 107 extending between the side plate 106 and the guide plate 102. In the embodiment shown, the support member 107 includes a front portion 108 and a bottom portion 109.

The guide plate 102 extends substantially vertically from the bottom portion 109 such that when the trigger guide 100 is mounted to a firearm 150, the guide plate 102 is substantially parallel to the direction of motion of trigger 152. The guide plate 102 is positioned such that it extends vertically from the bottom portion 109 at a fixed distance from the trigger 152. In some forms, the trigger guide 100 may be made in various sizes such that the position of the guide plate 102 relative to the trigger 152 varies to accommodate the size of a user's finger. As mentioned above, when mounted to the firearm 150, the guide plate 102 provides an indication to a user that their finger is properly positioned on the trigger 152 when their finger engages the guide plate 102. Thus, before firing the firearm 150, the user may ensure their finger engages the guide plate 102 before squeezing the trigger 152 at a consistent finger depth.

The guide plate 102 may further include a recessed region 110 on an internal side 102A thereof. The recessed region 110 is bounded by two walls 110A extending parallel to one another. The two walls 110A may be positioned such that when the guide plate 102 is attached to a firearm 150, the two walls 110A are vertically aligned with the proper vertical position on the trigger 152 where a user's trigger finger should be positioned. Thus, when a user places their finger on the trigger 152, the user may position their finger between the two walls 110A to ensure their finger engages the proper vertical position of the trigger 152. The walls 110A serve to provide tactile feedback to the user that their finger is at the proper vertical position of the trigger 152. For instance, if the user's trigger finger is not within the recessed region 110, the user may slide their finger along the guide plate 102 until their finger is between the two walls 110A and within the recessed region 110. Once the user's finger is between the two walls 110A or engaging both the walls 110A, the user's finger is at the proper vertical position on the trigger 152. The trigger guide 100 thus may provide an indication to the user that their finger is at the proper position in both the lateral and vertical directions.

In another form, the internal side 102A of the guide plate 102 does not include a recessed region 110 or walls 110A, but rather includes parallel extending ridges that a user places their finger in between. These ridges serve to provide the same function as the walls 110A described above.

Figure 2A:
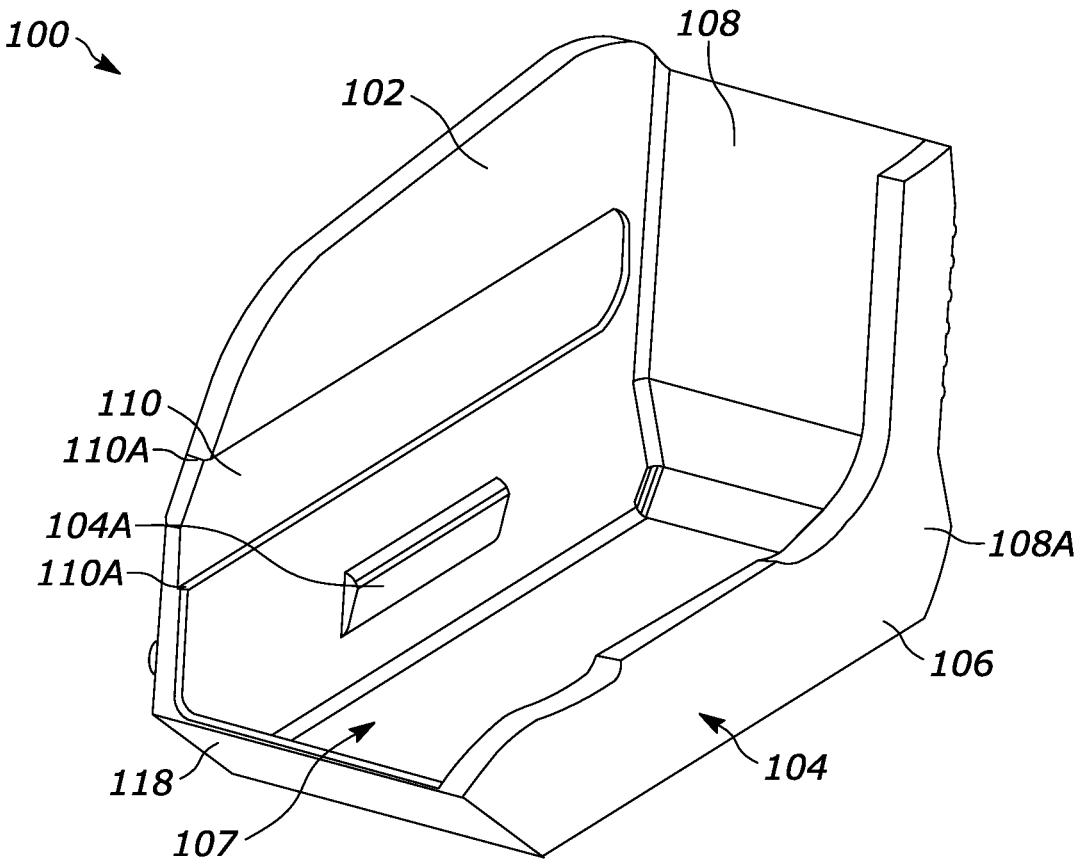
FIGS. 2A-E are left rear perspective, right rear perspective, right front perspective, rear elevation, and right side elevation views, respectively, of a trigger guide separated from a firearm.
Figure 2B:
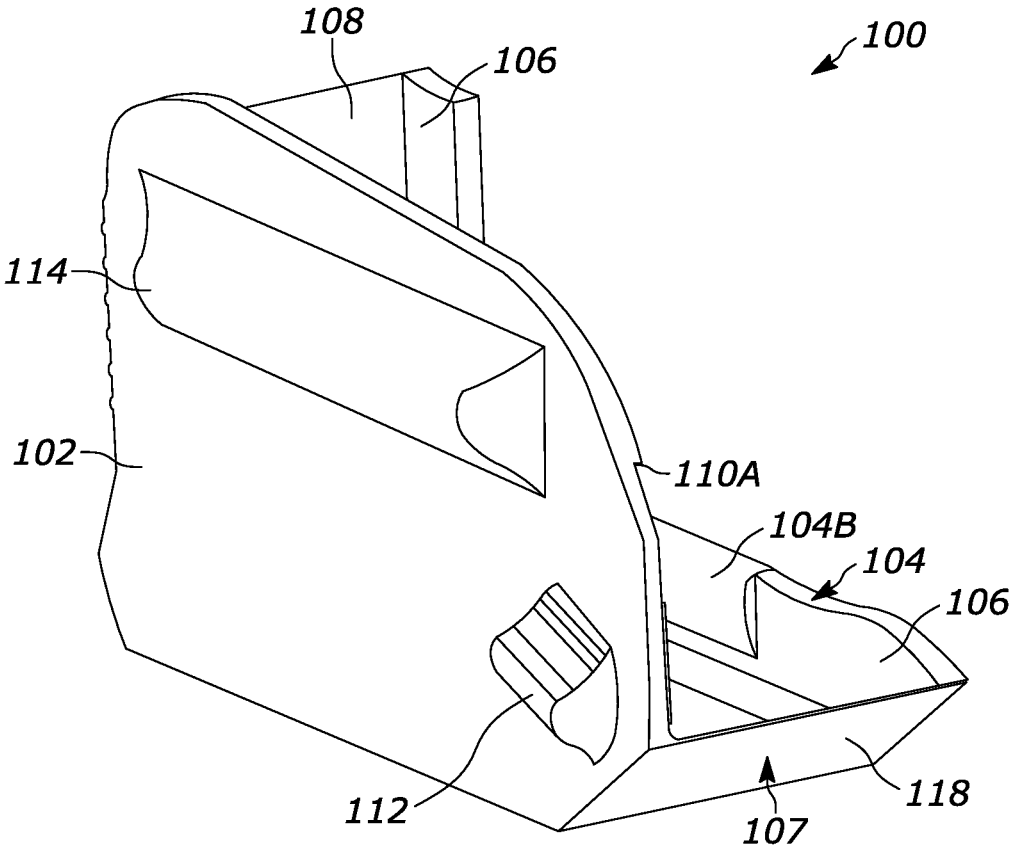
Figure 2C:
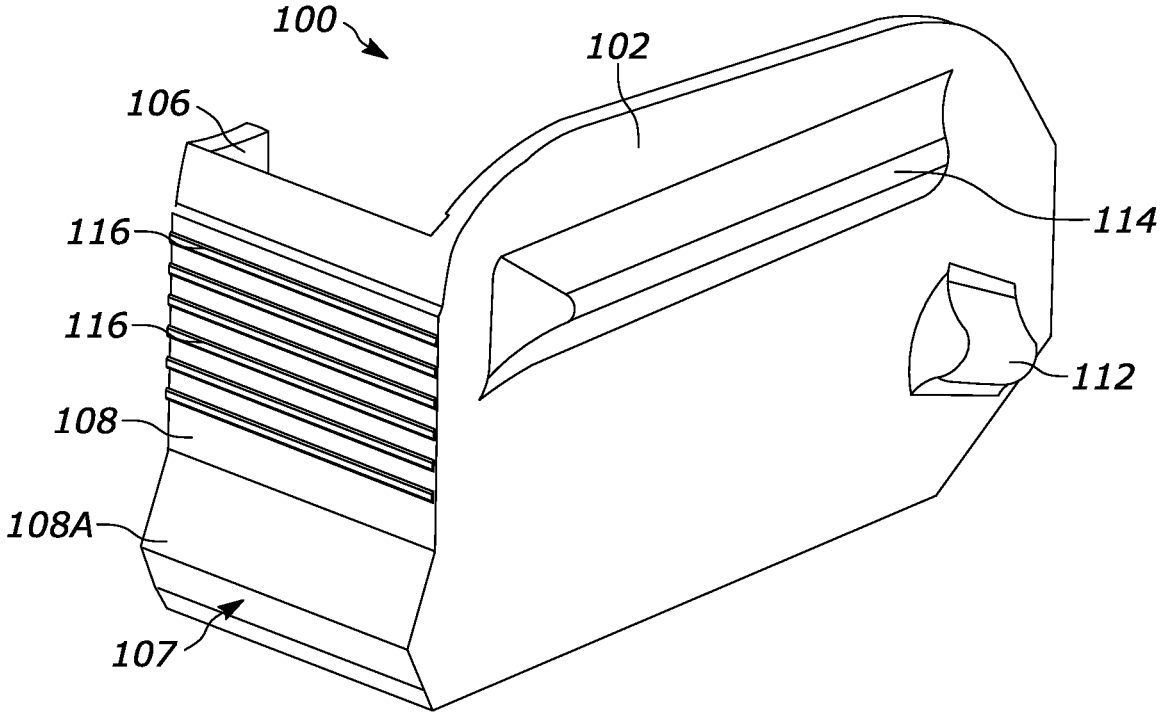
Figure 2D:
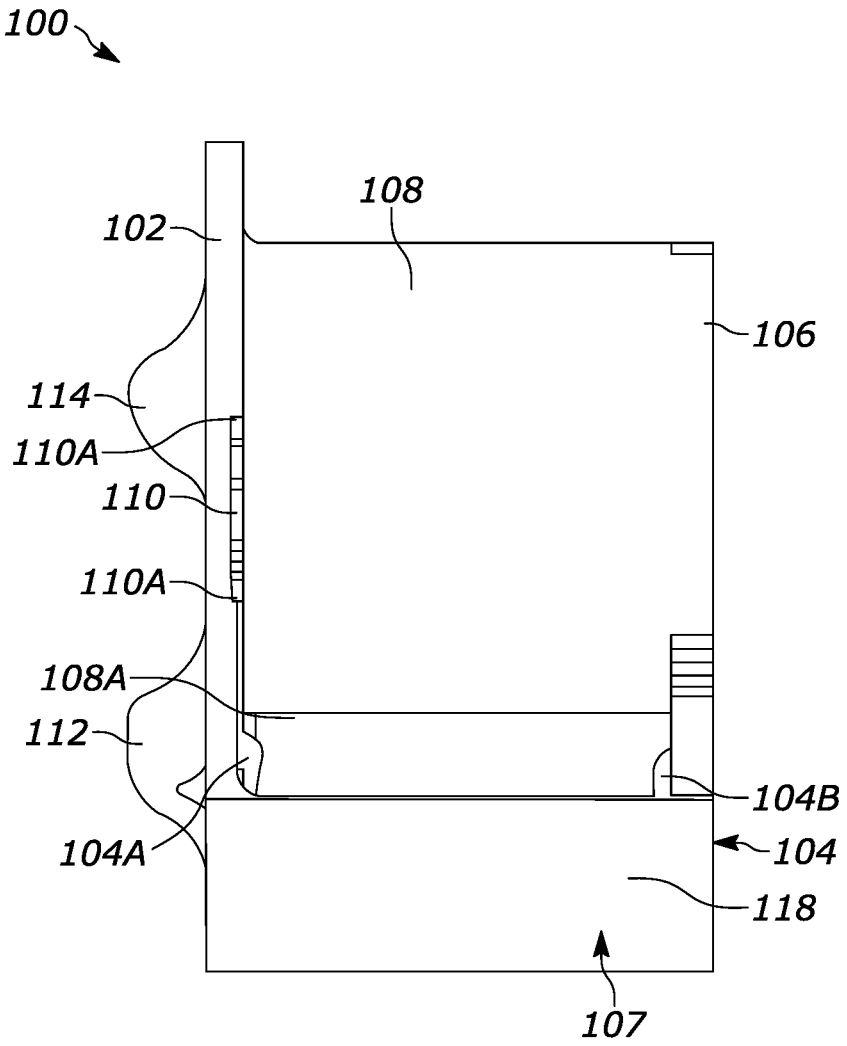
Figure 2E:
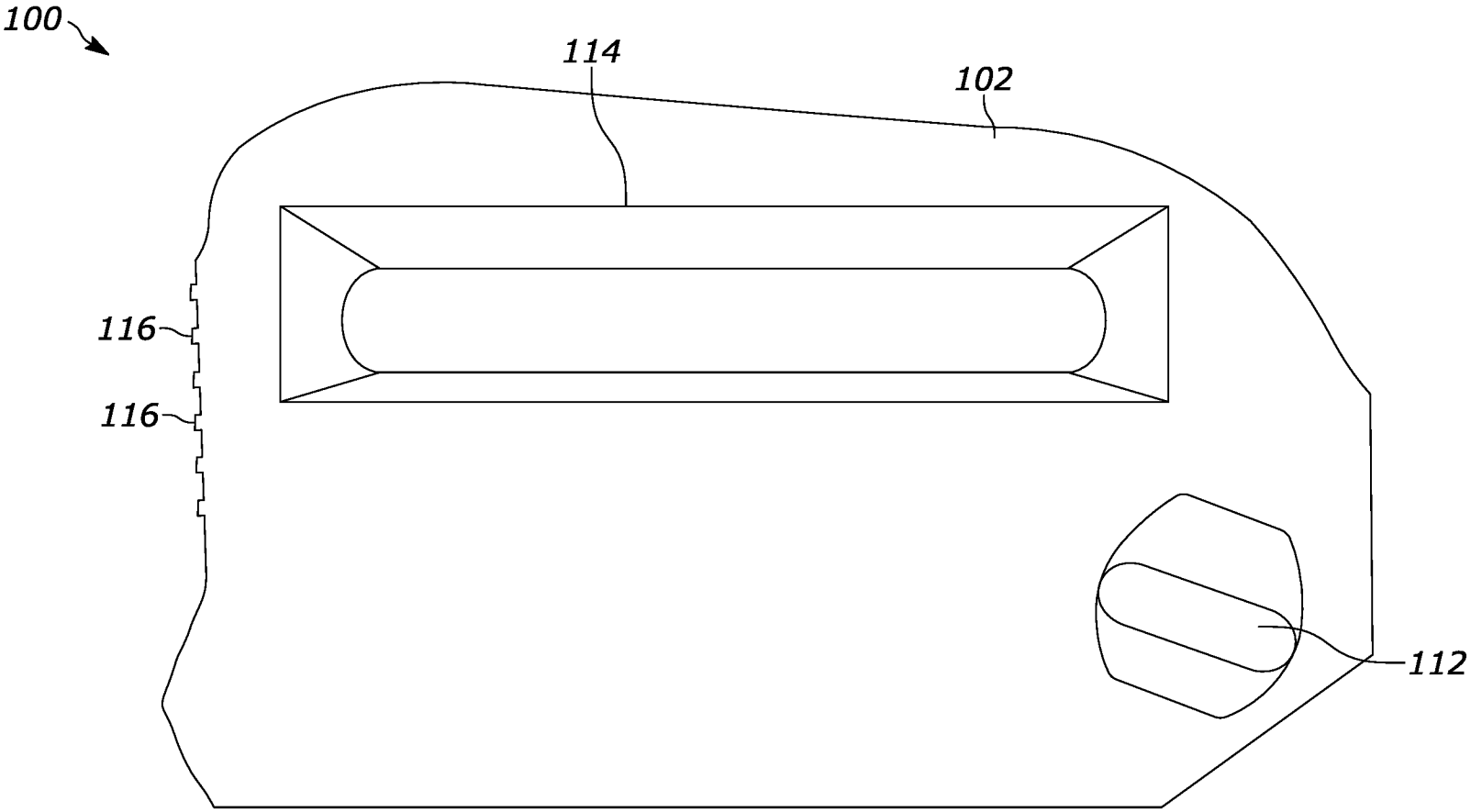
Figure 3A:
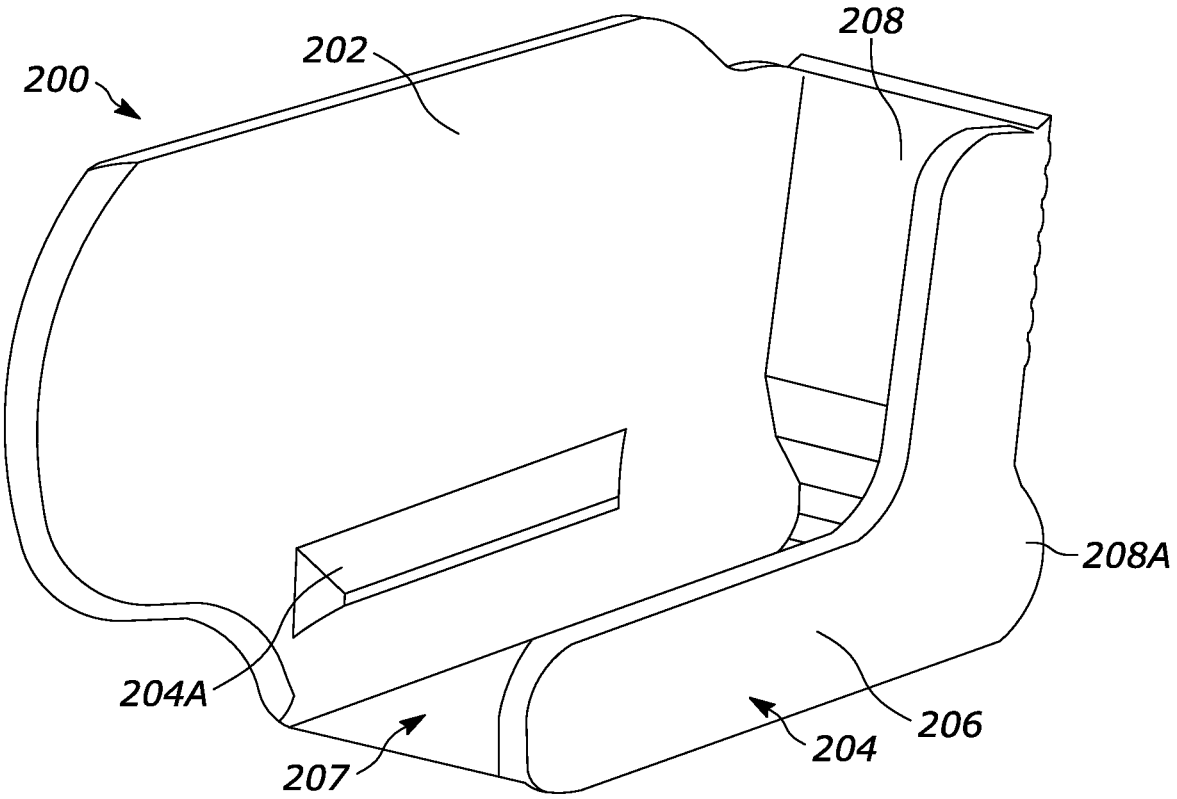
FIGS. 3A-E are left rear perspective, right rear perspective, right front perspective, rear elevation, and right side elevation views, respectively, of a trigger guide according to another form.
Figure 3B:
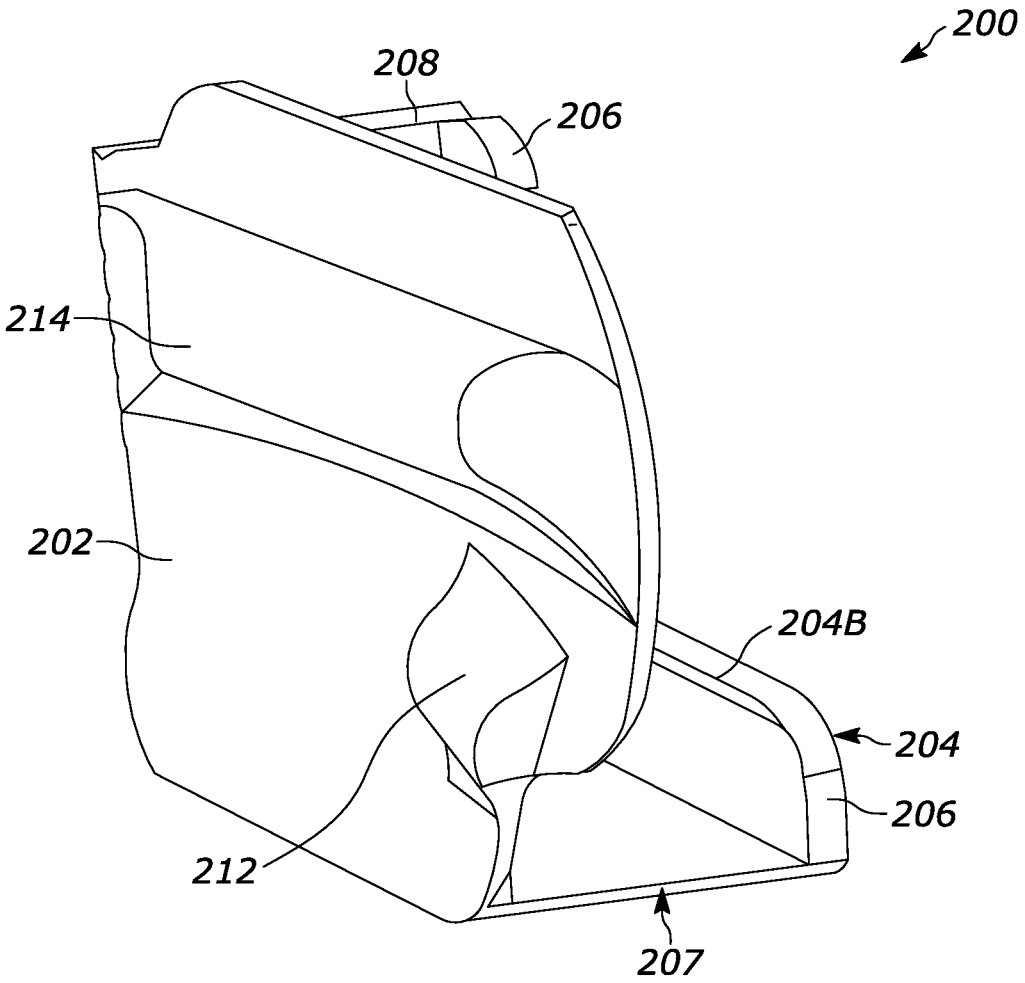
Figure 3C:
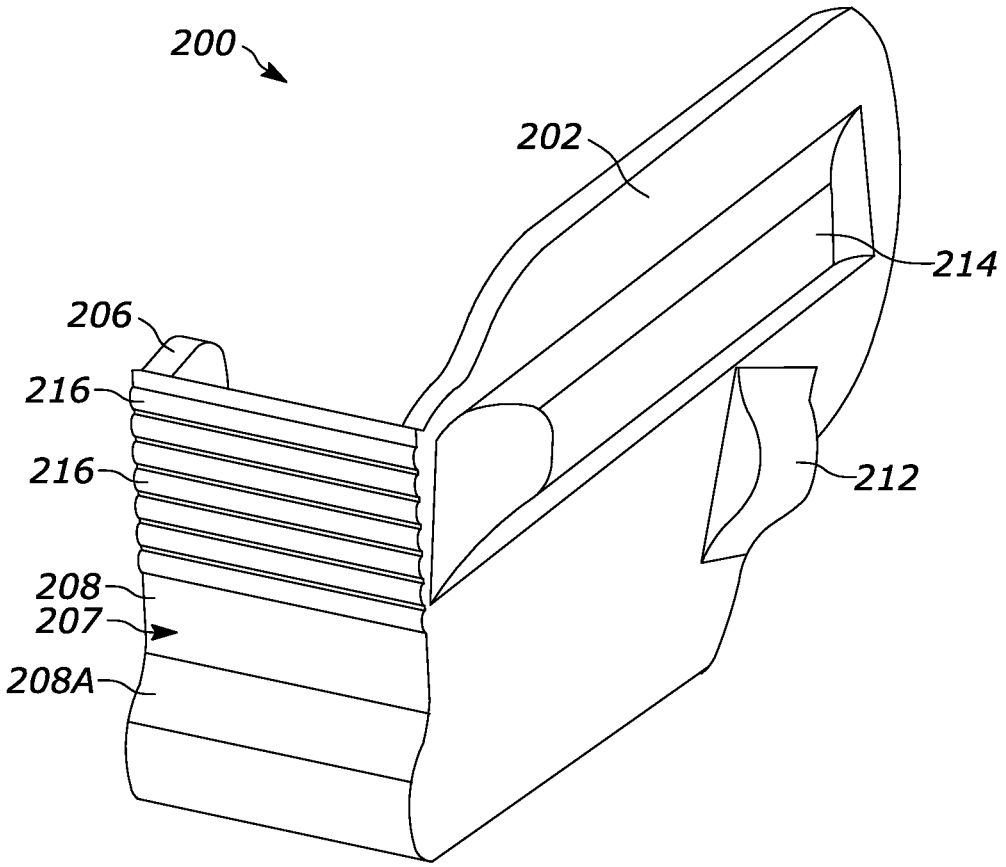
Figure 3D:
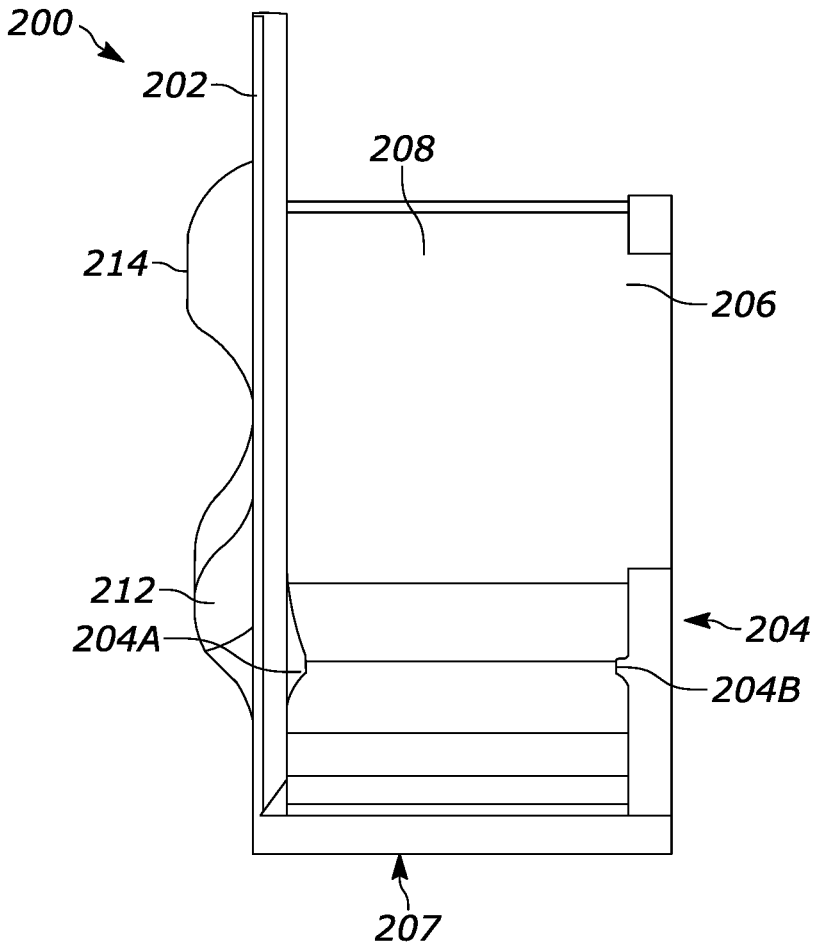
Figure 3E:
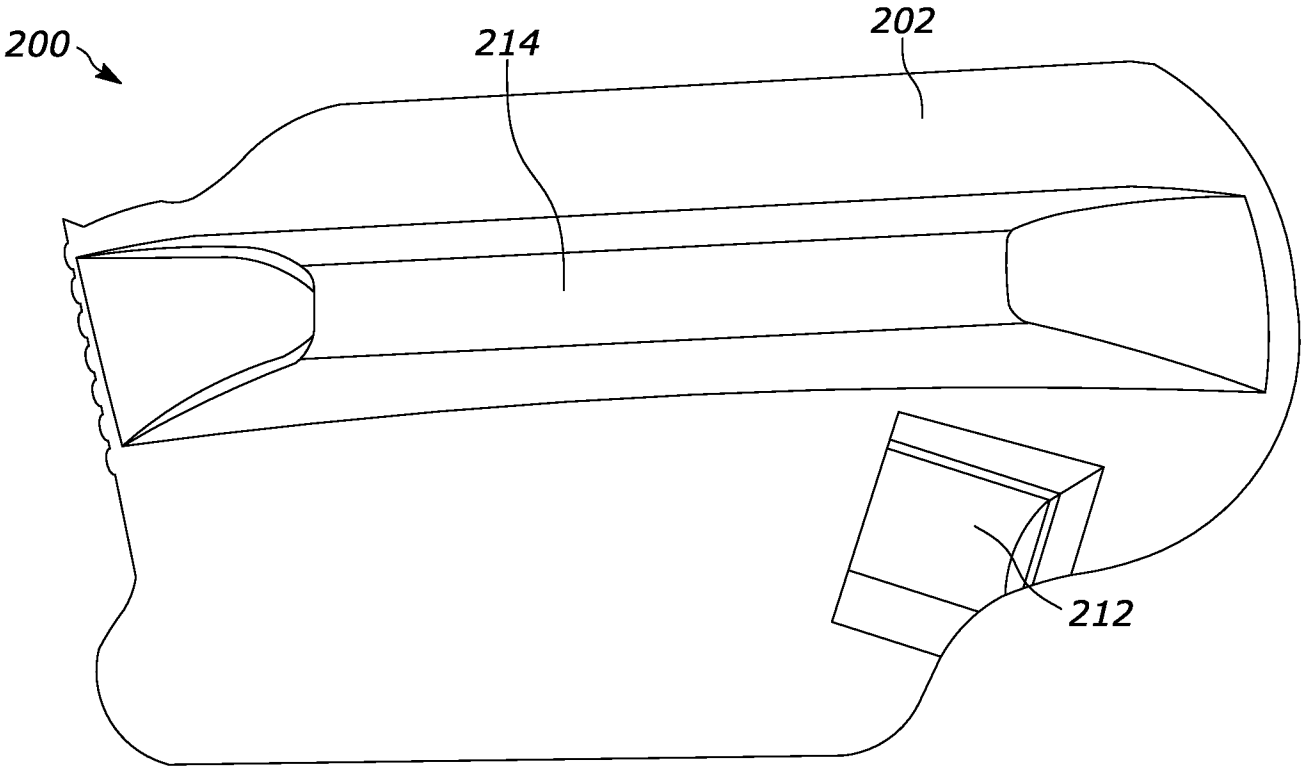

In some embodiments, the two walls 110A further define a track enabling an insert to be placed, applied, slid, or snapped into the recessed region 110. The inserts may have varying thickness and be used to fine tune the distance between a portion of the guide plate 102 that the user's finger engages and the trigger 152. As shown in FIG. 2A, for example, the insert may be inserted from the rear end of the guide plate 102 between the two walls 110A. Where the trigger guide includes two ridges rather than walls 110A, the ridges may define a track for an insert to be slid along. Where a user desires that the end of their finger be closer to the trigger 152, the user may insert a thicker insert to bring the portion of the guide plate 102 their finger engages closer to the trigger 152. Similarly, when the user desires their finger to extend further into the trigger well or over the trigger 152, the user may remove or reduce the thickness of the insert. In some forms, the insert may provide a concave surface along which the tip of the user's finger travels as the user pulls the trigger. When training, a user may cycle through a plurality of varying inserts until they find an insert that results in the minimum amount of movement of the firearm when squeezing the trigger 152.

An external side 102B of the guide plate 102 includes a removal protrusion 112 and a second protrusion 114 extending away from the guide plate 102. The removal protrusion 112 provides a surface that the user may grip or press on to detach the trigger guide 100 from the firearm 150. The removal protrusion 112 may be positioned such that the user may press downward on the top side of the removal protrusion 112 while holding the firearm 150, for example, with the thumb of their non-firing hand. This enables a user to quickly detach or flick off the trigger guide 100 when needed. The removal protrusion 112 is positioned near the proximal end of the trigger guide 100 as this uses the length of the trigger guide 100 as a lever when removing the trigger guide 100, which enables the user to more easily detach the trigger guide 100. Thus, the protrusion 112 serve as pry-point to flick the trigger guide 100 off of the firearm 150. A user may rest the thumb of their non-firing hand on the second protrusion 114.

The attachment portion 104 is arranged to engage the trigger guard 154 of the firearm 150 to secure the trigger guide 100 to the firearm 150. The attachment portion 104 wraps around the trigger guard 154 from the guide plate 102 via the support member 107 to the side plate 106. The attachment portion 104 includes a protrusion 104A extending inwardly from the internal surface 102A of the guide portion 102 and a protrusion 104B extending inwardly from the side plate 106. The protrusions 104A,B hook or snap over the trigger guard 154 to secure the trigger guide 100 to the firearm 150. For example, when attaching the trigger guide 100 to the firearm 150, the protrusions 104A,B are brought into engagement with the trigger guard 154 of the firearm 150. Force is applied to the trigger guide 100 to pass the protrusions 104A,B over the trigger guard 154. When the protrusions 104A,B pass over the trigger guard 154, the guide plate 102 and the side plate 106 are deflected or flex away from one another. Once the protrusions 104A,B have passed over the trigger guard 154, the guide plate 102 and side plate 106 elastically return to their original positions. Force in the opposite direction is required to cause the protrusions 104A,B to pass back over the trigger guard 154 and thus the trigger guide 100 is secured to the firearm 150. Thus, the trigger guide 100 can be snapped onto the trigger guard 154 of the firearm 150.

In the embodiment shown, the protrusions 104A,B extend along the bottom portion 109 of the trigger guide 100 and snap over the bottom member of the trigger guard 154. In other embodiments the protrusion 104A extends from the guide plate 102 along the front portion 108 and the protrusion 104B extends from the side plate 106 along the front portion 108 and snap over the front member of the trigger guard 154. In yet other embodiments, the protrusions 104A,B include portions that extend along both the bottom portion 109 and the front portion 108 to snap over both the bottom and front member of the trigger guard 154.

The side plate 106 wraps around the trigger guard 154 of the firearm 150 to engage the side of the trigger guard 154 opposite the guide plate 102. When a user places their finger on the trigger 152 and engages the guide plate 102, the guide plate 102 is secured from moving laterally by the engagement of the side plate 106 against the trigger guard 154. Thus, the side plate 106 aids to keep the trigger guide 100 attached to the firearm 150.

The bottom portion 108 and the front portion 109 of the support member 107 extend between the guide plate 102 and the side plate 106. The bottom portion 108 and the front portion 109 may provide strength or support enabling the guide plate 102 and the side plate 106 to return to their original position when flexed apart from on another during attachment and detachment of the trigger guide 100. The bottom portion 108 and the front portion 109 together prevent the guide plate 102 from flexing or moving outward when a user's finger engages the guide plate 102. The bottom portion 108 and the front portion 109 may also increase the rigidity of the trigger guide 100, thus requiring a greater force to attach and detach the trigger guide 100. In some embodiments, the support member 107 of the trigger guide 100 includes only the front portion 108 or only the bottom portion 109 extending between the guide plate 102 and the side plate 106. These configurations may be desirable for embodiments where the trigger guide 100 is adapted to be used by both left-handed and right handed users. For instance, the trigger guide 100 may be attached to the firearm 150 such that the guide plate 102 is on the left side of the trigger 152 and also may be attached such that the guide plate 102 is on the right side of the trigger 152.

In the embodiment shown, the protrusions 104A,B are shaped such the portion of the protrusion 104A,B that engages the trigger guard 154 when detaching the trigger guide 100 gradually extends away from the guide plate 102 and the side plate 106, respectively. This creates a gradual slope that the trigger guard 154 slides over when removing the trigger guide 100 which requires less force to remove the trigger guide 100. Thus, this configuration enables the trigger guide 100 to be detached with reduced force, for example, by pressing the removal protrusion 112 as described above, when needed. In other embodiments, the protrusions 104A,B are shaped symmetrically such that the force required to attach or detach the trigger guide 100 is substantially the same.

The front plate 108 includes a plurality of ribs 116 extending laterally across the front plate 108. These ribs 116 aid the user in gripping the trigger guide 100 when attaching or detaching the trigger guide 100 to the firearm 150. The front plate 108 may include any features or designs (e.g., ribs 116) that otherwise appear on the front surface of the trigger guard 154 of the firearm 150. This may aid to keep the trigger guide 100 discreet and inconspicuous when attached to the trigger guard 154.

As shown in the embodiment of FIGS. 2A-E, front plate 108 of the trigger guide 100 includes a forwardly extending bulge 108A that accommodates the shape of the trigger guard 154 of the firearm 150. The trigger guide 100 also includes an angled rear plate 118 that extends rearwardly and at an angle from the bottom plate 109 and extends between the guide plate 102 and the side plate 106. This angled rear plate 118 is included in this specific embodiment to follow the contour of the trigger guard 154 of a specific firearm model (i.e., a Glock 17). The angled rear plate 118 may provide further strength and support to the trigger guide 100, particularly in aiding the guide plate 102 and side plate 106 to return to their original position upon attachment or detachment from the firearm. Further, the shape may help prevent the trigger guide from being snagged on surfaces, such as during removal from a holster, pocket, and the like. For example, the protrusions are rounded to aid in sliding the trigger guide 100 into a holster and mitigate snagging or catching on the holster.

In other embodiments, the front plate 108 may not include such a bulge 108A or the angled rear plate 118, particularly when adapted for other firearm models. The portion of the trigger guide 100 extending between the guide plate 102 and the side plate 106 may be shaped to accommodate and generally follow the contours of the trigger guard 154 of a specific firearm 150.

In use, a user may attach the trigger guide 100 to a firearm 150. To do this, the user may position the protrusions 104A,B of the trigger guide 100 adjacent the trigger guard 154 of the firearm 150. The user may apply a force to deflect the protrusions 104A,B away from one another and over the trigger guard 154 until the protrusions 104A,B have passed over the trigger guard 154 and return to their original position. The protrusions 104A,B then engage the internal portion of the trigger guard 154 and is then secured to the firearm 150. The user may grip the trigger guide 100 using the ribs 116 on the front portion 108 of the trigger guide 100, the removal protrusion 112, and/or the second protrusion 114 to aid in gripping the trigger guide 100 when attaching it to the firearm 150.

When a user desires to fire the firearm, the user may aim the firearm at an intended target and place their index finger on the trigger 152 of the firearm 150. When placing their finger on the trigger 152, the user extends their finger into the trigger well until the tip of their index finger engages the guide plate 102. The user may adjust the vertical position of their index finger until their finger is within the two walls 110A or ridges of the guide plate 102. When ready to fire, the user may then squeeze or pull the trigger 152.

To detach the trigger guide 100, the user applies a downward force on the top surface of the removal protrusion 112. Upon applying a great enough force, the protrusions 104A,B are brought into engagement with the inner surface of the trigger guard 154 and deflected away from one another. Where the removal protrusion 112 is on the rear end of the trigger trainer 112, the rear ends of the protrusions 104A,B may initially be flexed apart from one another followed by the remainder of the protrusions 104A,B. The trigger guide 100 may thus be twisted away from the trigger guard 154 by twisting the rear end of the trigger guide 100 about the front end of the trigger guide 100. Once the entirety of the protrusions 104A,B have passed over the trigger guard 154, the trigger guide 100 is detached from the firearm 150. The trigger trainer 100 is reusable and may subsequently be reattached to the firearm 150 as described above.

With reference to FIGS. 3A-E, a trigger guide 200 according to a second embodiment is shown. The trigger guide 200 is similar to the trigger guide 100 of FIGS. 1A-2E, but has a different design to enable the trigger guide 200 to attach to a different model firearm (i.e., a SIG P320). The primary differences between the trigger guide 200 of the second embodiment and the trigger guide 100 of the first embodiment are highlighted in the following discussion. For clarity and conciseness, the references numerals used for features of the trigger guide 100 of the first embodiment that correspond to similar features of the trigger guide 200 of the second embodiment will be used with the prefix changed from a "1" to a "2." For example, a feature of the trigger guide 100 referenced by the reference numeral "110" will be shown with reference numeral "210" with regard to the trigger guide 200.

In the trigger guide 200, the protrusion 204B of the side plate 206 is a lip extending along a top edge of the side plate 206. The protrusion 204B functions in the same manner as the protrusion 104B to hook the inner edge of the trigger guard 254 of the firearm 150 to secure the trigger trainer 200 the firearm 150.

Another difference is that the internal surface 202A of the guide plate 202 does not include a recessed portion or ridges to guide the user in the vertical placement of their finger on the trigger 252 of the firearm 250. In other embodiments, however, the guide plate 202 may include a recessed region as in the first embodiment, ridges, or a single ridge to provide the user with an indication of the vertical placement of their finger on the trigger 152.

While the particular embodiments of the trigger guide described and shown herein are adapted to be used with particular models of handguns, those having skill in the art will readily appreciate the dimensions and shape of the trigger guide can be adjusted and modified to accommodate firearms of different size and dimensions. For instance, the trigger guide can be adapted for use with handguns, rifles, other firearms without departing from the scope of the present disclosure. Additionally, the trigger guide embodiments can be adapted for use with right-handed or left-handed shooters. In some forms, the trigger guide is universal and can be positioned on the trigger guard in a right-handed or left-handed configuration.

Moreover, those having skill in the art will readily appreciate that the trigger guide may be made from any one or more materials that enable the trigger guide to be removably attached to a firearm. For instance, in some forms, portions of the trigger guide, such as the guide plate, may be formed of a rigid material (e.g., a metal) to prevent the guide plate form flexing substantially when a user engages the guide plate with their finger while the attachment protrusions may be formed of a softer material, such as a plastic or rubber, to enable the attachment protrusions to be passed over the trigger guard of the firearm.

The embodiments of the trigger guide disclosed herein are designed to be low profile and conform to the shape of the trigger guard of the firearm. Thus, the trigger guides are designed to enable the trigger guides to remain attached to the firearm even when the user is no longer training or using the firearm. For instance, the firearm may be stored in a holster with the trigger guide still attached. Also, due to the low profile and generally rounded protrusions and edges, the trigger guides may remain attached to the firearm when inserting and removing the trigger guide from a holster without snagging or catching on the holster.

The trigger guide embodiments train a user to place the proper portion of their finger on the trigger (lateral placement), but also include features such as ridges, ribs, or the like to train users to place their finger at the proper vertical position along the trigger. Moreover, as described above, some embodiments of the trigger guide allow the trigger guide to be adjusted via inserts into received in the guide plate. This enables a user to fine tune their finger placement on the trigger. Thus, a user is able to determine the optimal position for their finger on the trigger for increased accuracy and train themselves to instinctively position their finger at the optimal position. Thus, users may be better trained to use their weapons with increased accuracy and consistency.

Uses of singular terms such as "a," "an," are intended to cover both the singular and the plural, unless otherwise indicated herein or clearly contradicted by context. The terms "comprising," "having," "including," and "containing" are to be construed as open-ended terms. It is intended that the phrase "at least one of" as used herein be interpreted in the disjunctive sense. For example, the phrase "at least one of A and B" is intended to encompass A, B, or both A and B.

While there have been illustrated and described particular embodiments of the present invention, those skilled in the art will recognize that a wide variety of modifications, alterations, and combinations can be made with respect to the above described embodiments without departing from the scope of the invention, and that such modifications, alterations, and combinations are to be viewed as being within the ambit of the inventive concept.

What is claimed is:

1. A firearm attachment comprising:

a first side wall;

a second side wall, the second side wall defining an opening for permitting a user's finger to extend and engage a trigger when installed on a firearm;

a bottom wall extending between the first side wall and the second side wall and spacing the first side wall from the second side wall to define a space therebetween for receiving a trigger guard of the firearm;

a first attachment protrusion extending from the first side wall toward the second side wall for engaging the trigger guard of the firearm; and a second attachment protrusion extending from the second side wall toward the first side wall for engaging the trigger guard of the firearm.

2. The firearm attachment of claim 1 wherein the first side wall is arranged to extend substantially parallel to a trigger of the firearm when the trigger guard is received within the space between the first side wall and second side wall.

3. The firearm attachment of claim 2 wherein the first attachment protrusion extends toward the second attachment protrusion thereby defining a narrowed region between the first side wall and the second side wall.

4. The firearm attachment of claim 3 wherein the first attachment protrusion and second attachment protrusion engage an internal surface of the trigger guard to retain the trigger guard to the firearm attachment.

5. The firearm attachment of claim 3 wherein the first side wall and the second side wall are elastically deflectable from one another such that the first side wall and the second side wall deflect from one another to allow the trigger guard to pass between the first and second protrusions.

6. The firearm attachment of claim 1 further comprising a removal protrusion coupled to and extending away from the first side wall for removing the firearm attachment from the firearm when attached thereto.

7. The firearm attachment of claim 6 wherein the removal protrusion is positioned proximal the rear end of the first side wall and proximal the portion of the first side wall connected to the bottom wall.

8. The firearm attachment of claim 1 wherein the first side wall is arranged such that when the trigger guard of the firearm is received within the space between the first side wall and the second side wall the first side wall is a set distance from a trigger of the firearm to indicate a lateral finger placement position.

9. A firearm attachment comprising:

a first side wall, the first side wall defines a recessed region for indicating a vertical finger placement position;

a second side wall;

a bottom wall extending between the first side wall and the second side wall and spacing the first side wall from the second side wall to define a space therebetween for receiving a trigger guard of a firearm;

a first attachment protrusion extending from the first side wall toward the second side wall for engaging the trigger guard of the firearm; and a second attachment protrusion extending from the second side wall toward the first side wall for engaging the trigger guard of the firearm.

10. The firearm attachment of claim 9 wherein the recessed region forms a first wall extending substantially parallel to a second wall.

11. The firearm attachment of claim 10 wherein the first wall and the second wall form a track for receiving an insert to adjust a lateral finger placement position.

12. The firearm attachment of claim 1 further comprising a front wall extending between the first side wall and the second side wall and spacing the first side wall from the second side wall.

13. The firearm attachment of claim 1 further comprising a rear wall extending between the first side wall and the second side wall and extending at an angle relative to the bottom wall.

14. The firearm attachment of claim 1 further comprising a finger rest protrusion coupled to and extending away from the first side wall.

15. A method comprising:

providing a firearm having a trigger and a trigger guard extending about the trigger;

providing a trigger guide comprising an attachment portion for clipping the trigger guide to the trigger guard and a guide plate configured to extend adjacent to and substantially parallel to a direction of motion of the trigger, the trigger guide including a first side wall, a second side wall, and a bottom wall extending between the first and second side walls, the second side wall defining an opening for permitting a user's finger to extend to engage the trigger; and attaching the trigger guide to the firearm by clipping the attachment portion of the trigger guide to the trigger guard.

16. The method of claim 15 further comprising:

placing a finger on the trigger of the firearm; and sliding the finger laterally across the trigger to bring an end of the finger into engagement with a guide plate of the trigger guide.

17. The method of claim 16 further comprising:

sliding the finger at least in part vertically along the trigger to bring the finger into contact with a wall of the guide plate indicating a vertical finger placement position.

18. The method of claim 15 further comprising:

removing the trigger guide from the firearm by applying a force to an upper side of a removable protrusion of the guide plate.

19. The method of claim 15 wherein the attachment portion includes a first attachment protrusion and a second attachment protrusion, the first attachment protrusion extending toward the second attachment protrusion, wherein clipping the attachment portion to the trigger guard includes bringing the first attachment protrusion and the second attachment protrusion into engagement with the trigger guard and passing the trigger guard between the first attachment protrusion and the second attachment protrusion.

20. The firearm attachment of claim 1 further comprising a rear wall positioned between the first side wall and second side wall and extending from the bottom wall, the rear wall defining a rear opening to permit a portion of the firearm to extend therethrough when installed on the firearm.

* * * * *